US009849326B2

(12) United States Patent
Smith

(10) Patent No.: US 9,849,326 B2
(45) **Date of Patent: *Dec. 26, 2017**

(54) MAGNETIC WEIGHT SELECTOR

(71) Applicant: ICON Health & Fitness, Inc., Logan, UT (US)

(72) Inventor: Kent M. Smith, Nibley, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/642,282

(22) Filed: Mar. 9, 2015

(65) Prior Publication Data

US 2015/0251042 A1 Sep. 10, 2015

Related U.S. Application Data

(60) Provisional application No. 61/950,587, filed on Mar. 10, 2014.

(51) Int. Cl.
*A63B 21/062* (2006.01)
*A63B 24/00* (2006.01)

(52) U.S. Cl.
CPC ..... *A63B 21/0628* (2015.10); *A63B 21/063* (2015.10); *A63B 24/0087* (2013.01); *A63B 2209/08* (2013.01)

(58) Field of Classification Search
CPC ..... A63B 21/062; A63B 21/0626; A63B 21/0628; A63B 21/063; A63B 21/0632; A63B 24/0087; A63B 2209/08; A63B 21/06
See application file for complete search history.

(56) References Cited

U.S. PATENT DOCUMENTS 5,123,885 A 6/1992 Shields
5,306,221 A * 4/1994 Itaru ..... A63B 21/0628 482/97
5,350,344 A * 9/1994 Kissel ..... A63B 21/0628 310/15
5,556,362 A * 9/1996 Whipps ..... A63B 21/0628 482/97

(Continued)

FOREIGN PATENT DOCUMENTS

CN 1541731 A 11/2004
CN 1617756 A 9/2005

(Continued)

OTHER PUBLICATIONS

International Search Report issued for PCT/US2015/019522 dated May 19, 2015.

(Continued)

*Primary Examiner* — Joshua Lee
(74) *Attorney, Agent, or Firm* — Holland & Hart LLP

(57) ABSTRACT

A weight plate for use in a weight stack of an exercise machine includes a locking member moveably attached to the weight plate between an interlocked position and an unlocked position. The weight plate further includes an interlocking magnet attached to the weight plate to retain the locking member in the interlocked position and an unlocking magnet attached to the weight plate to retain the locking member in the unlocked position.

20 Claims, 10 Drawing Sheets

(56) References Cited

U.S. PATENT DOCUMENTS 6,015,367 A * 1/2000 Scaramucci ..... A63B 21/0628 482/5
6,117,049 A 9/2000 Lowe
6,224,519 B1 5/2001 Doolittle
6,632,161 B1 * 10/2003 Nir ..... A63B 24/00 482/5
6,997,856 B1 * 2/2006 Krull ..... A63B 21/075 482/104
7,011,609 B1 * 3/2006 Kuo ..... A63B 21/0628 482/94
7,179,208 B1 2/2007 Nalley
7,473,211 B2 * 1/2009 Lee ..... A63B 21/0628 482/94
7,507,189 B2 3/2009 Krull
7,540,832 B2 * 6/2009 Krull ..... A63B 21/0628 482/98
7,608,021 B1 * 10/2009 Nalley ..... A63B 21/0628 482/98
7,815,554 B2 * 10/2010 Gibson ..... A63B 21/0628 482/100
7,946,968 B2 5/2011 Kjellberg
8,047,970 B2 11/2011 Nalley
8,708,870 B2 * 4/2014 Nalley ..... A63B 21/063 482/98
8,777,820 B2 * 7/2014 Lo ..... A63B 21/00065 482/98
2002/0025888 A1 2/2002 Germanton et al.
2003/0060344 A1 * 3/2003 David ..... A63B 21/0628 482/98
2006/0217245 A1 9/2006 Golesh et al.
2007/0004569 A1 1/2007 Cao
2007/0072748 A1 * 3/2007 Lee ..... A63B 21/00072 482/93
2008/0015094 A1 1/2008 Casagrande
2008/0161170 A1 * 7/2008 Lumpee ..... A63B 21/0628 482/98
2008/0188362 A1 8/2008 Chen
2009/0048079 A1 2/2009 Nalley
2009/0163334 A1 6/2009 Gibson et al.
2009/0227432 A1 * 9/2009 Pacheco ..... A63B 21/0628 482/101
2010/0285933 A1 11/2010 Nalley
2011/0028282 A1 * 2/2011 Sbragia ..... A63B 21/0628 482/99
2012/0004075 A1 * 1/2012 Kissel ..... A63B 21/155 482/5
2012/0004080 A1 1/2012 Webb

FOREIGN PATENT DOCUMENTS

CN 2722969 Y 9/2005
CN 201643528 U 11/2010
CN 203183566 U 9/2013
WO 2008119067 10/2008

OTHER PUBLICATIONS

International Search Report issued for PCT/US2015/019515 dated May 19, 2015.
Chinese Search Report issued in Application No. 2015800132874 dated Jun. 23, 2017.
Machine translated English Abstract of CN1541731A. Nov. 3, 2004.
Machine translated English Abstract of CN2722969Y. Sep. 7, 2005.
Machine translated English Abstract of CN201643528U. Nov. 24, 2010.
Machine translated English Abstract of CN203183566U. Sep. 11, 2013.

* cited by examiner

MAGNETIC WEIGHT SELECTOR

RELATED APPLICATIONS

This application claims priority to provisional Patent Application No. 61/950,587 titled "An Automated Weight Selector" filed Mar. 10, 2014.

BACKGROUND

While there are numerous exercise activities that one may participate in, exercise may be broadly broken into the categories of aerobic exercise and anaerobic exercise. Aerobic exercise generally refers to activities that substantially increase the heart rate and respiration of the exerciser for an extended period of time. This type of exercise is generally directed to enhancing cardiovascular performance. Such exercise usually includes low or moderate resistance to the movement of the individual. For example, aerobic exercise includes activities such as walking, running, jogging, swimming or bicycling for extended distances and extended periods of time.

Anaerobic exercise generally refers to exercise that strengthens skeletal muscles and usually involves the flexing or contraction of targeted muscles through significant exertion during a relatively short period of time and/or through a relatively small number of repetitions. For example, anaerobic exercise includes activities such as weight training, push-ups, sit-ups, pull-ups, or a series of short sprints.

To build skeletal muscle, a muscle group is contracted against resistance. The contraction of some muscle groups produces a pushing motion, while the contraction of other muscle groups produces a pulling motion. A cable machine is a popular piece of exercise equipment for building those muscle groups that produce pulling motions. A cable machine often includes a cable with a handle connected to a first end and a resistance mechanism connected to a second end. Generally, the resistance mechanism is an selectable set of weights. A midsection of the cable is supported with at least one pulley. To move the cable, a user pulls on the handle with a force sufficient to overcome the force of the resistance mechanism. As the cable moves, the pulley or pulleys direct the movement of the cable and carry a portion of the resistance mechanism's load.

One type of cable exercise machine is disclosed in U.S. Patent Publication No. 2002/0025888 issued to Kyle M. Germanton. In this reference, an exercise machine has an automatic and programmable resistance selection apparatus with vertically aligned weights that are selectable by rotatably engaging a lift pin to select each weight stack. The exercise machine further includes a control module from which the number of weights to be lifted can be ordered by the user. Alternatively, the number of weights being lifted may be programmed from a remote location. Other types of cable exercise machines are described in U.S. Pat. No. 7,473,211 issued to Byung-don Lee and U.S. Pat. No. 6,117,049 issued to John C. Lowe.

SUMMARY

In a preferred embodiment of the present invention, a weight plate for use in a weight stack of an exercise machine includes a locking member moveably attached to the weight plate. The locking member has a interlocked position and a unlocked position. The weight plate further includes an interlocking magnet attached to the weight plate to retain the locking member in the interlocked position and an unlocking magnet attached to the weight plate to retain the locking member in the unlocked position.

One aspect of the invention that may be combined with one or more other aspects herein, the weight plate may further include a cavity defined by the at least one plate, wherein the locking member is at least partially disposed within the cavity.

One aspect of the invention that may be combined with one or more other aspects herein, the cavity is defined by an entrance through which an exposed end of the locking member extends, a first wall located adjacent the locking member in the interlocked position, and a second wall located adjacent the locking member in the unlocked position.

One aspect of the invention that may be combined with one or more other aspects herein, the interlocking magnet is positioned proximate the first wall One aspect of the invention that may be combined with one or more other aspects herein, the unlocking magnet is positioned proximate the second wall.

One aspect of the invention that may be combined with one or more other aspects herein, the cavity may be lined with a non-magnetic material.

One aspect of the invention that may be combined with one or more other aspects herein, the interlocking magnet and the unlocking magnet may abut a non-magnetic material.

One aspect of the invention that may be combined with one or more other aspects herein, the interlocking magnet and the unlocking magnet may be encased in a non-magnetic material.

One aspect of the invention that may be combined with one or more other aspects herein, the locking member is connected to the weight plate via a pivot shaft.

One aspect of the invention that may be combined with one or more other aspects herein, a lift opening may be formed in the weight plate One aspect of the invention that may be combined with one or more other aspects herein, the interlocking magnet is positioned on the at least one plate on a first side of the lift opening.

One aspect of the invention that may be combined with one or more other aspects herein, the pivot shaft is positioned on the at least one plate on a second side of the lift opening.

One aspect of the invention that may be combined with one or more other aspects herein, the weight plate may include further a plurality of guide openings formed in the weight plate.

In another preferred embodiment of the present invention, an exercise machine includes a frame and a weight assembly with multiple plates moveably disposed along a vertical length of the frame. The exercise machine also includes a lifting member selectively engaged with the weight assembly, and the multiple plates each include at least one lift opening to receive the lifting member. The lifting member is oriented transverse to a plate length and to travel in a transverse direction with respect to the plate length. Further, the exercise machine includes a locking member associated with at least one plate of the multiple plates, and a selector having a interlocked position and a unlocked position. When the selector is in the interlocked position, the locking member is interlocked with the lifting member. When the selector is in the unlocked position, the locking member is disengaged from the lifting member.

One aspect of the invention that may be combined with one or more other aspects herein, the locking member is connected to the at least one plate with a pivot shaft.

One aspect of the invention that may be combined with one or more other aspects herein, the locking member has an interlocking region that resides in a notch formed in the lifting member.

One aspect of the invention that may be combined with one or more other aspects herein, the selector comprises a linear actuator to cause the locking member to change positions.

One aspect of the invention that may be combined with one or more other aspects herein, the selector further comprises a catching surface to catch an exposed end of the locking member such that the locking member pivots into a different position when the linear actuator is actuated.

One aspect of the invention that may be combined with one or more other aspects herein, the catching surface is shaped to free the exposed end of the locking member to move with respect to the catching surface along the length of the frame.

One aspect of the invention that may be combined with one or more other aspects herein, the catching surface is incorporated on an actuator lever that is pivotally movable when the linear actuator is actuated.

One aspect of the invention that may be combined with one or more other aspects herein, the exercise machine includes a control module that includes a weight selecting input mechanism in communication with a processor that causes the selector to position the locking member.

One aspect of the invention that may be combined with one or more other aspects herein, multiple selectors movable to position multiple locking members connected to multiple plates.

One aspect of the invention that may be combined with one or more other aspects herein, the exercise machine includes a magnet positioned to retain the locking member in the interlocked position.

One aspect of the invention that may be combined with one or more other aspects herein, the exercise machine includes a magnet positioned to retain the locking member in the unlocked position.

One aspect of the invention that may be combined with one or more other aspects herein, the frame includes guide posts that are partially disposed within guide openings that are positioned on opposing sides of the multiple plates, the guide posts being oriented to guide the multiple plates as the multiple plates move along the length of the frame.

One aspect of the invention that may be combined with one or more other aspects herein, an exercise machine includes a frame.

One aspect of the invention that may be combined with one or more other aspects herein, the exercise machine includes a weight assembly comprising multiple plates moveably disposed along a vertical length of the frame with a lifting member.

One aspect of the invention that may be combined with one or more other aspects herein, the multiple plates comprising lift openings that receive the lifting member.

One aspect of the invention that may be combined with one or more other aspects herein, the lifting member being oriented transverse to a plate length and to travel in a transverse direction with respect to the plate length.

One aspect of the invention that may be combined with one or more other aspects herein, at least one of the multiple plates includes a locking member associated with at least one plate.

One aspect of the invention that may be combined with one or more other aspects herein, the exercise machine includes a selector that has an ability to cause the locking member to change from an interlocked position where the locking member is interlocked with the lifting member and an unlocked position where the locking member is disengaged from the lifting member.

One aspect of the invention that may be combined with one or more other aspects herein, the locking member is connected to the at least one plate with a pivot shaft.

One aspect of the invention that may be combined with one or more other aspects herein, the locking member has an interlocking region that resides in a notch formed in the lifting member.

One aspect of the invention that may be combined with one or more other aspects herein, the selector comprises a linear actuator causes the locking member to change positions.

One aspect of the invention that may be combined with one or more other aspects herein, the selector further comprises a catching surface that catches an exposed end of the locking member such that the locking member pivots into a different position when the linear actuator is actuated.

One aspect of the invention that may be combined with one or more other aspects herein, the catching surface is shaped to free the exposed end of the locking member to move with respect to the catching surface along the length of the frame.

One aspect of the invention that may be combined with one or more other aspects herein, the catching surface is incorporated on an actuator lever pivotally movable in response to movement of the linear actuator.

One aspect of the invention that may be combined with one or more other aspects herein, the exercise machine includes a control module that includes a weight selecting input mechanism in communication with a processor that causes the selector to position the locking member.

One aspect of the invention that may be combined with one or more other aspects herein, multiple selectors movable to position multiple locking members connected to multiple subsets of the multiple plates.

One aspect of the invention that may be combined with one or more other aspects herein, the exercise machine includes a magnet positioned to retain the locking member in the interlocked position.

One aspect of the invention that may be combined with one or more other aspects herein, the exercise machine includes a magnet positioned to retain the locking member in the unlocked position.

One aspect of the invention that may be combined with one or more other aspects herein, an exercise machine with a frame.

One aspect of the invention that may be combined with one or more other aspects herein, the exercise machine having a weight assembly comprising multiple plates moveably disposed along a vertical length of the frame with a lifting member.

One aspect of the invention that may be combined with one or more other aspects herein, the multiple plates comprising lift openings that receive the lifting member.

One aspect of the invention that may be combined with one or more other aspects herein, the lifting member being oriented transverse to a plate length and to travel in a transverse direction with respect to the plate length.

One aspect of the invention that may be combined with one or more other aspects herein, the frame includes guide posts that are partially disposed within guide openings that are positioned on opposing sides of the multiple plates, the guide posts being oriented to guide the multiple plates as they move along the length of the frame.

One aspect of the invention that may be combined with one or more other aspects herein, at least one of the multiple plates includes a locking member associated with at least one plate.

One aspect of the invention that may be combined with one or more other aspects herein, the exercise machine includes a selector that has an ability to cause the locking member to change from an interlocked position where the locking member is interlocked with the lifting member and an unlocked position where the locking member is disengaged from the lifting member.

One aspect of the invention that may be combined with one or more other aspects herein, the exercise machine includes a interlocking magnet is positioned to retain the locking member in the interlocked position.

One aspect of the invention that may be combined with one or more other aspects herein, the exercise machine includes a unlocking magnet is positioned to retain the locking member in the unlocked position.

One aspect of the invention that may be combined with one or more other aspects herein, the locking member is connected to the at least one plate with a pivot shaft.

One aspect of the invention that may be combined with one or more other aspects herein, the locking member has an interlocking region that resides in a notch formed in the lifting member.

One aspect of the invention that may be combined with one or more other aspects herein, the selector comprises a linear actuator causes the locking member to change positions.

One aspect of the invention that may be combined with one or more other aspects herein, the selector further comprises a catching surface catches an exposed end of the locking member such that the locking member pivots into a different position in response to movement of the linear actuator.

One aspect of the invention that may be combined with one or more other aspects herein, the catching surface is shaped to free the exposed end of the locking member to move with respect to the catching surface along the length of the frame.

One aspect of the invention that may be combined with one or more other aspects herein, the catching surface is incorporated on an actuator lever that is pivotally movable in response to movement of the linear actuator.

One aspect of the invention that may be combined with one or more other aspects herein, an exercise machine includes a frame.

One aspect of the invention that may be combined with one or more other aspects herein, the exercise machine includes a weight assembly comprising multiple plates moveably disposed along a vertical length of the frame.

One aspect of the invention that may be combined with one or more other aspects herein, the exercise machine includes a lifting member selectively engaged with the weight assembly.

One aspect of the invention that may be combined with one or more other aspects herein, the multiple plates each include at least one lift opening positioned to receive the lifting member.

One aspect of the invention that may be combined with one or more other aspects herein, lifting member being oriented transverse to a plate length and arranged to travel in a transverse direction with respect to the plate length.

One aspect of the invention that may be combined with one or more other aspects herein, the exercise machine includes a locking member associated with at least one plate of the multiple plates.

One aspect of the invention that may be combined with one or more other aspects herein, the exercise machine includes a interlocking magnet is positioned to retain the locking member in a interlocked position.

One aspect of the invention that may be combined with one or more other aspects herein, when the locking member is in the interlocked position, the locking member is interlocked with the lifting member.

One aspect of the invention that may be combined with one or more other aspects herein, when the locking member is in the unlocked position, the locking member is disengaged from the lifting member.

One aspect of the invention that may be combined with one or more other aspects herein, the locking member is connected to the at least one plate with a pivot shaft.

One aspect of the invention that may be combined with one or more other aspects herein, the interlocking magnet is positioned on an opposite side of the lift opening from the pivot shaft.

One aspect of the invention that may be combined with one or more other aspects herein, the interlocking magnet is positioned on an opposite side of the lift opening from the pivot shaft.

One aspect of the invention that may be combined with one or more other aspects herein, the frame includes guide posts that are partially disposed within guide openings that are positioned on opposing sides of the multiple plates, the guide posts being oriented to guide the multiple plates as the multiple plates move along the vertical length of the frame.

One aspect of the invention that may be combined with one or more other aspects herein, the interlocking magnet and unlocking magnet are incorporated into the at least one plate of the multiple plates.

One aspect of the invention that may be combined with one or more other aspects herein, the locking member is partially disposed within a cavity formed in the plate.

One aspect of the invention that may be combined with one or more other aspects herein, the cavity comprises an entrance through which the exposed end of the locking member protrudes.

One aspect of the invention that may be combined with one or more other aspects herein, the cavity comprises an opening formed in the underside of the plate.

One aspect of the invention that may be combined with one or more other aspects herein, the cavity comprises a first wall located to position the locking member in the interlocked position.

One aspect of the invention that may be combined with one or more other aspects herein, the interlocking magnet is positioned adjacent the first wall and the cavity.

One aspect of the invention that may be combined with one or more other aspects herein, the cavity comprises a second wall located to position the locking member in the unlocked position.

One aspect of the invention that may be combined with one or more other aspects herein, the unlocking magnet is positioned adjacent the second wall and the cavity.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Figure 1:
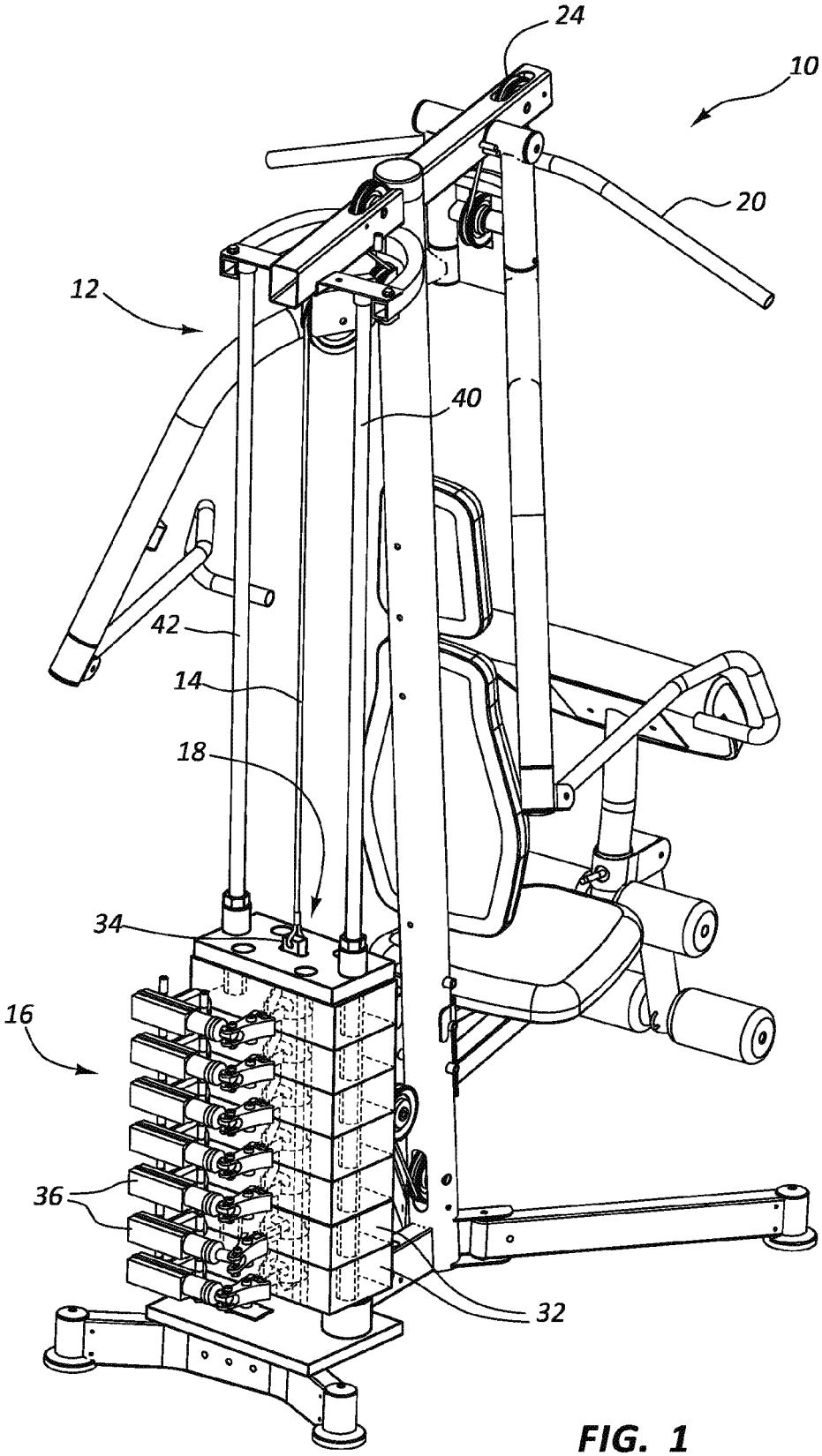
FIG. 1 illustrates a perspective view of an example of a cable exercise machine in accordance with the present disclosure.
Figure 2:
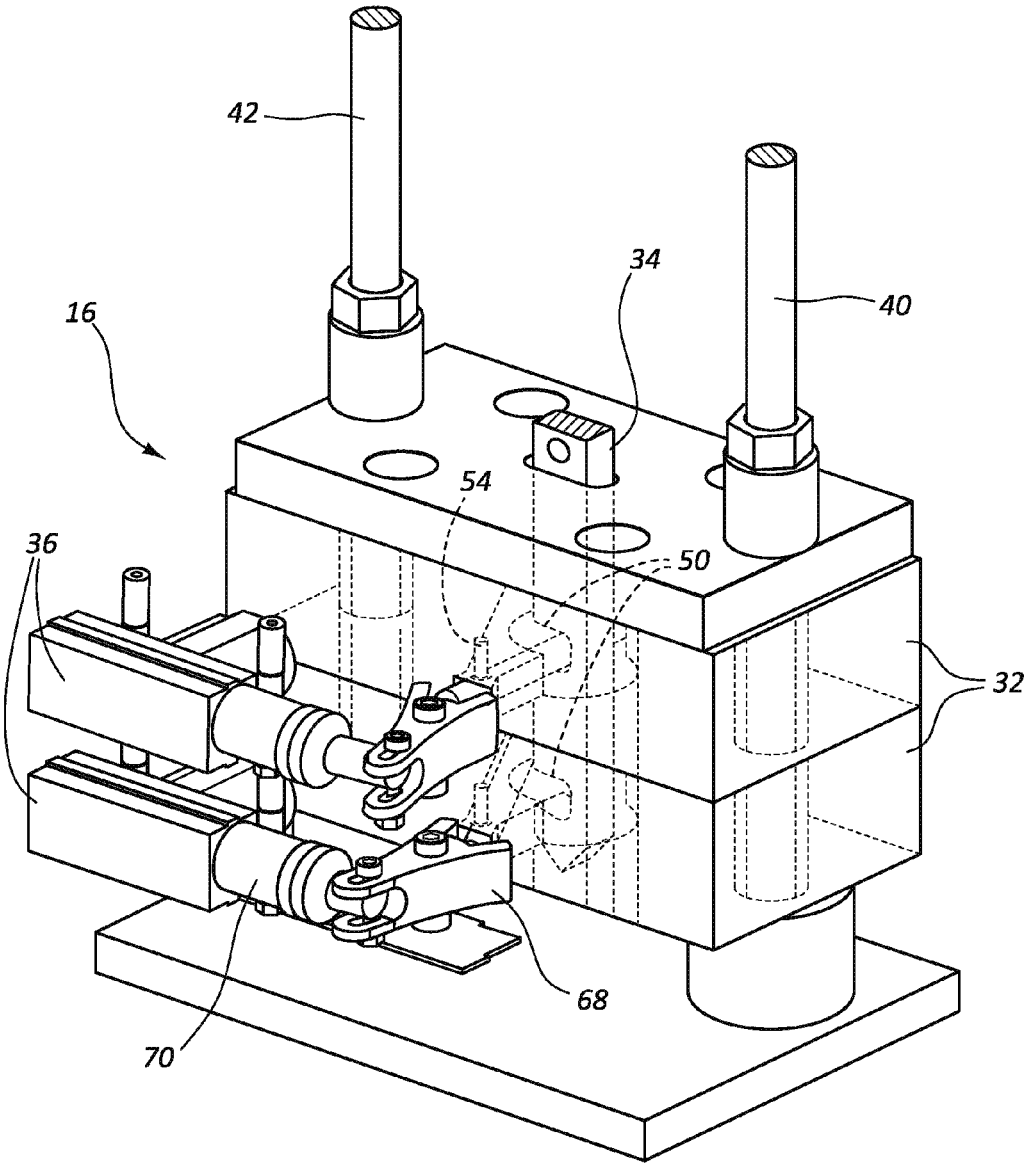
FIG. 2 illustrates a perspective view of an example of a weight assembly in accordance with the present disclosure.

Many commercially available cable exercise machines include a resistance mechanism that incorporates a weight assembly. Often, such weight assemblies involve a removable pin that a user inserts through an opening in a weight plate. As the user inserts the removable pin through the opening, a distal end of the pin is inserted into a lifting member that has another opening aligned with the opening formed in the weight plate. As a result, the removable pin interlocks the selected weight plate with the lifting member.

The lifting member is connected to an end of a pull cable, and a mid-portion of the pull cable is supported on a frame of the machine, often with a pulley. As the user pulls on the pull cable, the pulley or other routing mechanism of the pull exercise machine directs the forces exerted by the user to raise the lifting member in an upward direction. As the lifting member moves, the interlocked weight plate plus any weight plates supported by the interlocked weight plate moves with the lifting member. As a result, the weight of the weight plate and any other weight plates supported by the interlocked weight plate provide resistance to the user's pull.

The principles described in the present disclosure spare the user from having to manually insert the pin. Further, when the user desires to switch the weight, the principles described herein spare the user from having to remove the removable pin manually and reinsert it. The present disclosure describes an automated weight plate selector that can automatically interlock a locking member with a lifting member of the pull exercise machine without the user having to make manual adjustments.

The locking member may be integrated directly into the weight plate. In some examples, the locking member is pivotally attached to the weight plate with a pivot shaft. As the locking member rotates about the pivot shaft, a region of the locking member is rotated into or away from the lifting member. In such examples, a notch is formed in the lifting member and the locking member can be moved into and away from the notch. When a region of the locking member resides within the notch, the locking member interlocks the weight plate with the lifting member. As a result, when the lifting member moves in response to a pull from a user, the weight plate and any weight plates supported by the interlocked weight plate move with the lifting member.

A selector can control when the locking member is pivoted into the notch. In some examples, the selector includes a linear actuator that is connected to an actuator lever. As the linear actuator moves a push/pull rod forward and backward with respect to the linear actuator, the rod causes the actuator lever to pivot into a different position. The actuator lever is shaped to form a catching surface that catches an exposed end of the locking member such that the locking member pivots into a different position in response to movement of the linear actuator.

With reference to the present disclosure, the term "aligned" generally means parallel, substantially parallel, or forming an angle of less than 35 degrees. For purposes of this disclosure, the term "transverse" generally means perpendicular, substantially perpendicular, or forming an angle between 55 and 125 degrees.

Particularly, with reference to the figures, FIG. 1 depicts a cable exercise machine 10 with a frame 12 that supports a cable 14. A weight assembly 16 is attached to a lifting end 18 of the cable 14 and a handle 26 is connected to a pull end 22 of the cable 14. The cable 14 is supported with at least one pulley 24 that causes the pull forces exerted by the user on the pull end 22 of the cable 14 to raise the lifting end 18 of the cable 14.

The pull end 22 of the cable 14 may be equipped with a replaceable handle 26. The user can switch between different types of handles with different grips, widths, and/or angles to target the muscle groups desired to be worked by the user. A cable connector located at the pull end 22 may include a loop to which the replaceable handle 26 can be secured. In some embodiments, a stopper is attached to the pull end 22 of the cable 14. The stopper can include a large enough cross sectional thickness to stop the pull end 22 from being pulled into a pulley 24 or another feature of the cable exercise machine 10 that directs the movement of the cable 14.

The weight assembly 16 may include multiple weight plates 32 that are arranged to be lifted with the lifting end 18 of the cable 14 when interlocked with a lifting member 34 connected to the lifting end 18. One or more selectors 36 may be incorporated into the cable exercise machine 10 to cause a plate to interlock with the lifting member 34. In some examples, a selector 36 is associated with each plate in the weight assembly 16. In other examples, a selector 36 is associated with a single weight plate or a subset of the weight plates 32.

Figure 3:
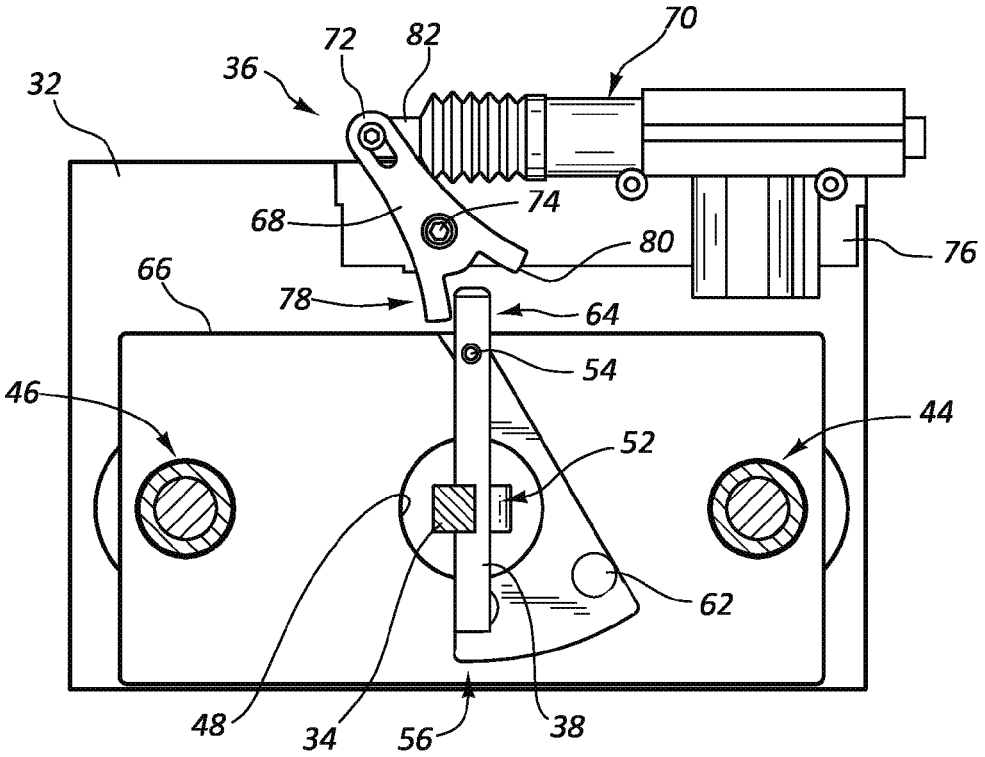
FIG. 3 illustrates a top view of the weight assembly of FIG. 2 with a locking member interlocked with a lifting member.
Figure 4:
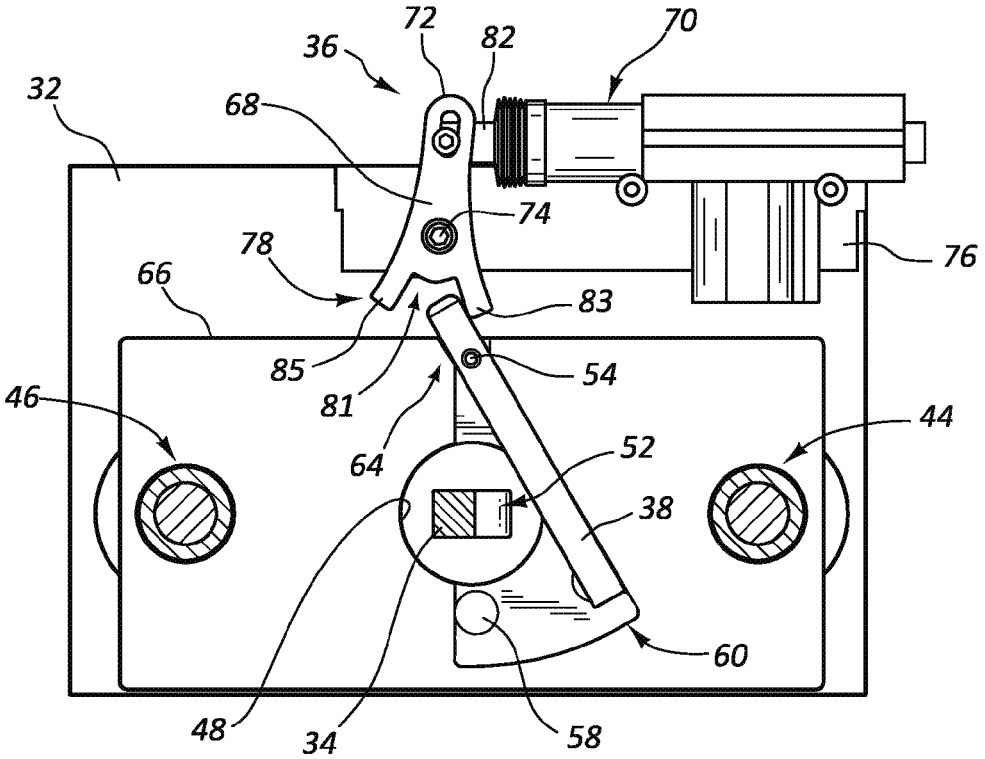
FIG. 4 illustrates a top view of the weight assembly of FIG. 2 with a locking member disengaged with a lifting member.
Figure 5A:
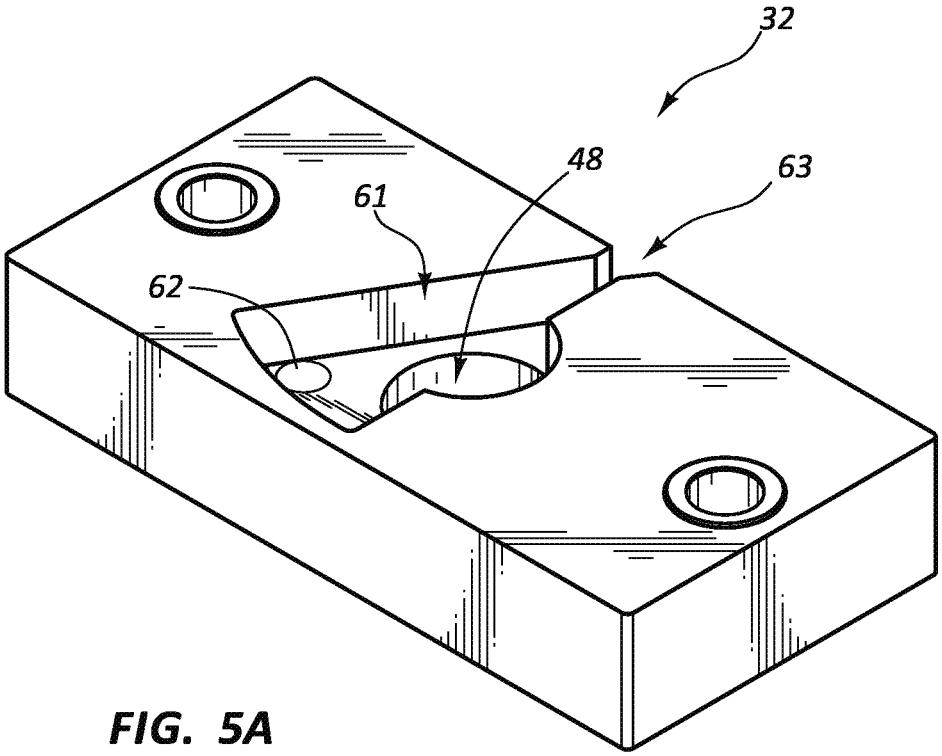
FIG. 5A illustrates a perspective view of an underside of the weight plate of FIG. 2.
Figure 5B:
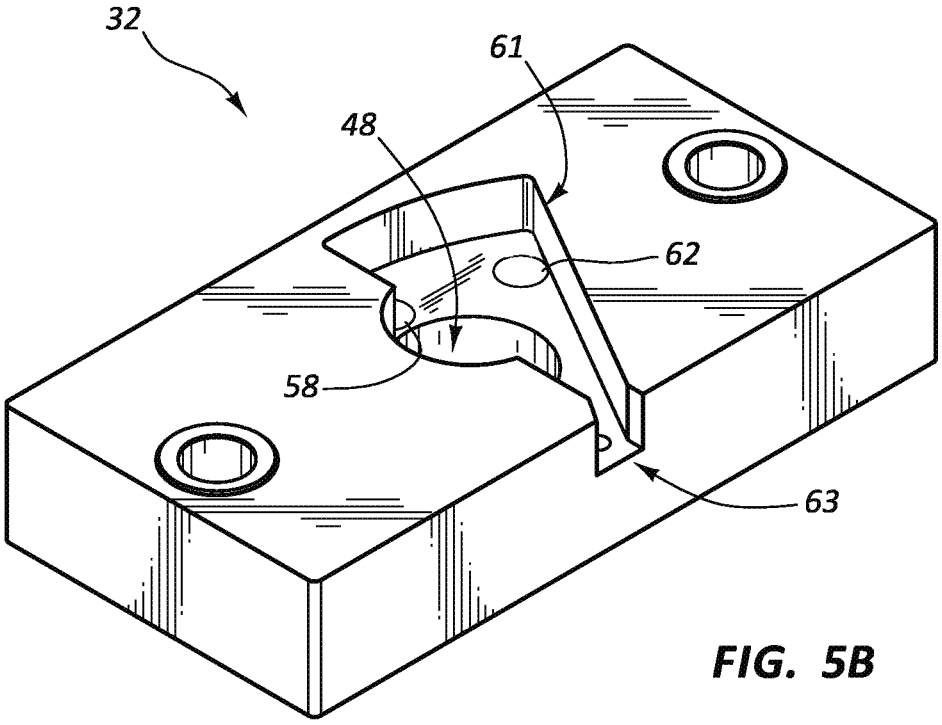
FIG. 5B illustrates a perspective view of an underside of the weight plate of FIG. 2.
Figure 6A:
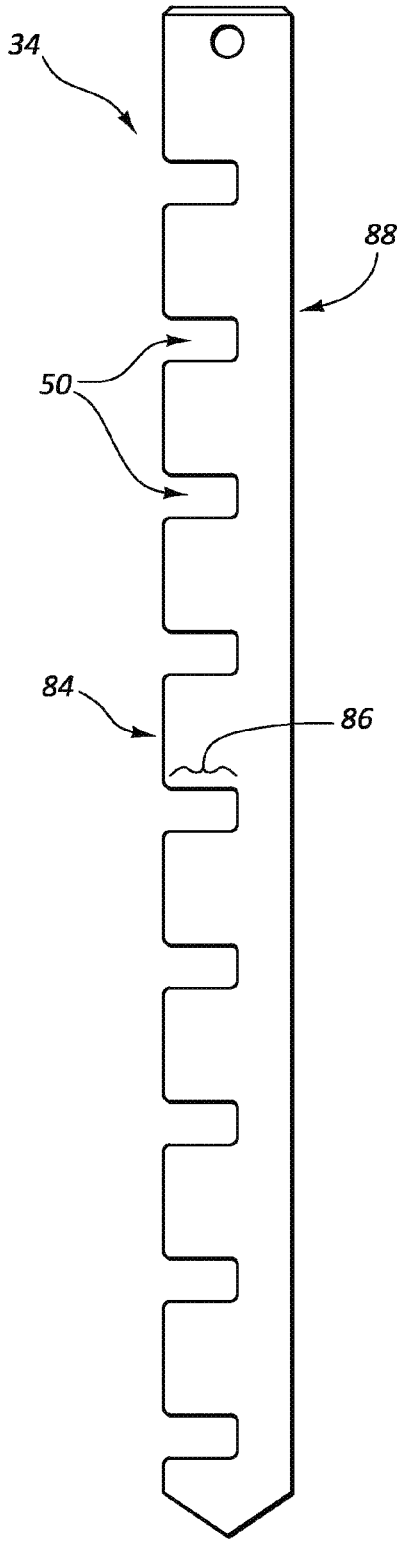
FIG. 6A illustrates a front view of the lifting member of FIG. 2.

FIGS. 2-6A illustrates different views of an example of the weight assembly 16 in accordance with the present disclosure. FIG. 3 illustrates a top view of the weight assembly 16 with a locking member 38 interlocked with a lifting member 34. FIG. 4 illustrates a top view of the weight assembly 16 with the locking member 38 disengaged from the lifting member 34. FIGS. 5A and 5B illustrate perspective views of the underside of the weight plates 32. FIG. 6A illustrates a front view the lifting member 34 in accordance with the present disclosure.

A first guide post 40 and a second guide post 42 direct the movement of the multiple weight plates 32 in a vertical direction. The guide posts 40, 42 may be rigidly attached to a base of the cable exercise machine 10 and a top of the machine's frame 12. The first guide post 40 is shaped to be inserted into a first guide opening 44 formed in the weight plates 32, and the second guide post 42 is shaped to be inserted into a second guide opening 46 also formed in the weight plates 32. A lift opening 48 is also formed in the weight plates 32 that is positioned and sized to receive the lifting member 34. In the illustrated example, the lift openings 48 are formed in the center of the weight plates 32. While the illustrated example has been described with reference to specific locations for the guide openings 44, 46 and the lift openings 48, these openings may be formed in any appropriate location of the weight plates 32. In some examples, at least one of the guide openings 44, 46 and lift opening 48 are grooves formed an edge of the weight plates 32.

The lifting member 34 includes multiple notches 50 that are sized to receive an interlocking region 52 of the locking member 38. In the illustrated example, the locking members 38 are attached to the weight plates 32 with a pivot shaft 54. The locking members 38 may rotate about the pivot shaft 54 within a range. At a first end of the range, the locking member 38 is in an interlocked position 56 with the interlocking region 52 being disposed within notch 50 formed in the lifting member 34. In examples where the locking member 38 is made of a magnetically conductive material, an interlocking magnet 58 may be incorporated into the weight plates 32 to apply a magnetic force to the locking member 38 to aid in retaining the locking member 38 in the interlocked position 56. At a second end of the range, the locking member 38 is in an unlocked position 60. In the unlocked position 60, the interlocking region 52 is outside of the notch 50. An unlocking magnet 62 may also be incorporated into the weight plate 32 and positioned to apply a magnetic force to retain the locking member 38 in the unlocked position 60.

When the locking member 38 is in the interlocked position 56, the locking member 38 is interlocked with the lifting member 34 and causes the weight plate 32 to move with the lifting member 34 in response to a pull force exerted by a user along the cable 14. On the other hand, when the locking member 38 is in the unlocked position 60, the locking member 38 is disengaged from the lifting member 34. Consequently, as the lifting member 34 moves in response to a pull force exerted by the user, the weight plate 32 may not move with the lifting member 34. In some examples, the weight plate 32 may still move with the lifting member 34 even when the locking member 38 is in the unlocked position 60. Such examples may include when the weight plate 32 is interlocked or supported by another weight plate. For instance, when a subjacent weight plate located underneath the unlocked weight plate is interlocked with the lifting member 34, the unlocked weight plate may move with the interlocked, subjacent weight plate.

The locking member 38 may be caused to pivot about the pivot shaft 54 at an exposed end 64 that protrudes beyond an edge 66 of the weight plate 32. The exposed end 64 may be pushed by an actuator lever 68 that is moved by a linear actuator 70. The actuator lever 68 may be connected to the linear actuator 70 at an actuator end 72 and may rotate about a fulcrum 74 attached to a selector plate 76 that supports at least some of the components of the selector 36. The rotation about the fulcrum 74 causes a contact end 78 of the actuator lever 68 to catch the exposed end 64 of the locking member 38 with a catching surface 80 formed on the contact end 78. The catching surface 80 may be shaped to push the locking member 38 into the unlocked position 60 when the linear actuator 70 extends a push/pull rod 82. Further, the catching surface 80 may also be shaped to push the locking member 38 into the interlocked position 56 when the linear actuator 70 retracts the push/pull rod 82.

Any appropriate type of linear actuator 70 may be used to cause the locking member 38 to interlock or move away from the lifting member 34. In some examples, an electro-mechanical actuator, such as a screw type actuator, wheel and axle type actuator, a cam type actuator, or another type of electro-mechanical actuator may be used in accordance with the principles described in the present disclosure. In other examples, hydraulic type actuators, pneumatic type actuators, piezoelectric type actuators, magnetostrictive type actuators, solenoids, other type actuators, or combinations thereof may be used in accordance with the principles described herein. In yet other examples, another type of actuator, other than a linear type actuator, may be used to cause the locking member 38 to move from the interlocked position 56 to the unlocked position 60 and vice versa.

The locking member 38 may be partially disposed within a cavity 61 formed in the weight plate 32. The cavity 61 may be fully enclosed with the exception of an entrance 63 where the exposed end 64 protrudes out of the weight plate 32. In other examples, the cavity 61 is open on the underside of the weight plate 32 as illustrated in FIGS. 5A and 5B. The cavity 61 may include walls that limit the locking member's range of pivot motion. The walls of the cavity 61 may provide a location to secure the interlocking magnet 58 and the unlocking magnet 62. However, the magnets 58, 62 may be located above or below the locking member 38 as well when the locking member 38 is in either of the positions. In yet other examples, the locking member 38 is attached below the weight plate 32 or another location outside of a cavity 61 of the weight plate 32.

In the example of FIG. 6A, the lifting member 34 includes multiple notches 50 formed in a notch side 84 of the lifting member 34. In such an example, the notch depth 86 is sufficiently deep to retain the locking member 38 when it is in the interlocked position 56. The lifting member 34 may be shaped to cause the load of the interlocked weight plate and other weight plates that are supported by the interlocked weight plate to spread to a support side 88 of the lifting member 34. The support side 88 has a sufficient thickness to support the defected loads. In some examples, all of the load from the interlocked plate and the plates situated above the interlocked plate are transferred into the lifting member 34 at a single notch.

However, in other examples, multiple locking members 38 are interlocked with the lifting member 34 at the same time. In such examples, the load of the raised weight plates are distributed over multiple notches 50. For example, if a user desires to lift forty pounds and each weight plate is ten pounds each, the user may send a command to the selectors 36 to lift forty pounds. In response to such a command, the selectors 36 may cause each of the locking members 38 associated with the top four plates in the weight assembly 16 to interlock with the lifting member 34. As a result, when the top four weight plates are raised, a load associated with each ten pound plate is distributed across the four notches associated with each of the interlocked weight plates. In other examples, the selectors 36 may respond to the command to interlock forty pounds by interlocking a single locking member associated with the fourth plate from the top of the weight stack. In such an example, the entire load is transferred to the lifting member 34 at the notch 50 associated with just the interlocked plate. In yet other examples, the selectors 36 may respond to the command to interlock forty pounds by interlocking just two of the locking members 38 associated with just two of the top four weight plates.

In some examples, a one-to-one ratio of selectors 36 to weight plates 32 exists. In such an example, each selector 36 can be dedicated to interlocking and unlocking a single weight plate with the locking member 38. In such an example, the selectors 36 may be rigidly fixed in place such that the selectors 36 remain in a stationary position with respect to the machine's frame 12 as the interlocked weight plate moves with the lifting member 34. In other examples, the selectors 36 may remain stationary with respect to the frame 12 as the interlocked weight plates move, but the selectors 36 have an ability to move vertically so that they can position the locking members 38 of more than one weight plate. In either of these examples, the catching surfaces 80 are shaped to free the exposed end 64 of the locking member 38 to move with respect to the catching surface 80 along the length of the frame 12. Such a catching surface 80 may be free of overhangs, ledges, or other types of protrusions that can catch the exposed ends 64 of the locking member 38 as the weight plates 32 travel with the lifting member 34.

The catching surface 80 may form a depression 81 shaped by a first prong 83 and a second prong 85. The first prong 83 may push the exposed end 64 of the locking member 38 such that the locking member 38 transitions into the unlocked position 60 as the linear actuator 70 extends the push/pull rod 82. Also, the second prong 85 may push the exposed end 64 of the locking member 38 such that the locking member 38 transitions into the interlocked position 56 as the linear actuator 70 retracts the push/pull rod 82. Both the first and second prongs 83, 85 may catch the exposed end 64 of the locking member 38 as the linear actuator 70 moves the actuator lever 68 in a direction that is transverse the lifting member's lifting direction. The exposed end 64 may reside in the depression 81 when the weight plate 32 is in a resting position regardless of whether the locking member 38 is in the interlocked position 56 or the unlocked position 60. However, the depression 81 is free of prongs, overhangs, protrusions, or other types of features that can catch the exposed end 64 as the weight plates 32 move with the lifting member 34.

Figure 6B:
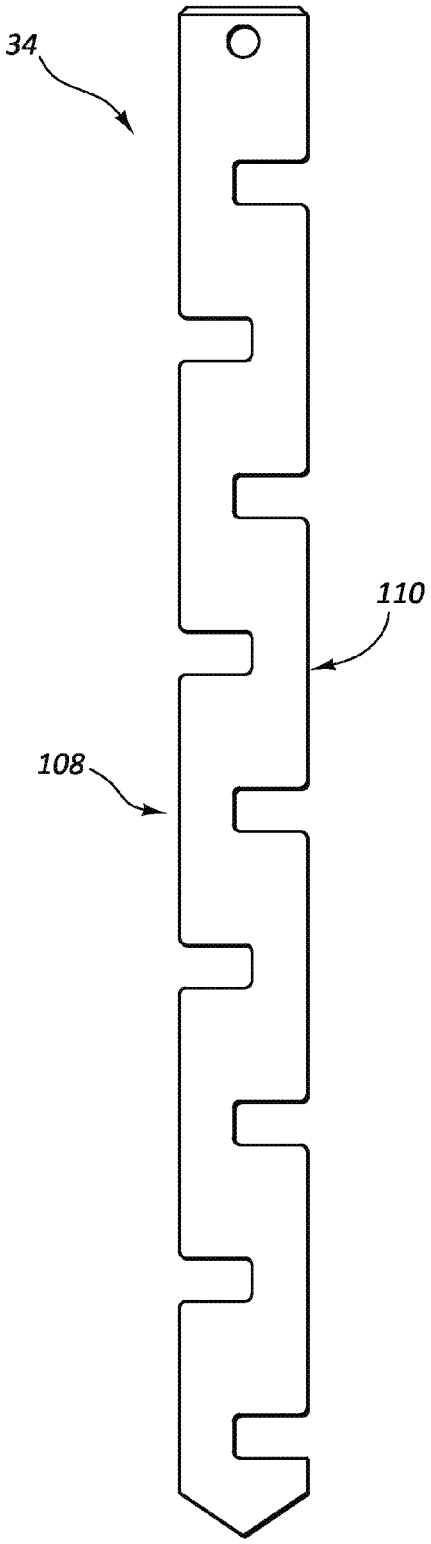
FIG. 6B illustrates a front view of an alternative example of a lifting member in accordance with the present disclosure.

FIG. 6B illustrates a front view of an example of a lifting member 34 in accordance with the present disclosure. In this example, the lifting member 34 includes notches 50 on first side 108 and a second side 110 of the lifting member 34. Having the notches 50 on more than one side of the lifting member 34 distributes the loads from the interlocked plates to an additional side. In other examples, the notches 50 may be formed in the lifting member 34 in more than two sides.

In such an example, the selectors 36 may be arranged such that some selectors 36 are on different sides of the cable exercise machine 10. In other examples, a single direction of the push/pull rod 82 causes some of the locking members 38 to move into the interlocked position 56 where the same direction causes other locking members to move into the unlocked position 60. For example, the extension of the push/pull rod 82 may cause locking members, which are configured to interlock with notches 50 on the first side 108 of the lifting member 34, to move into the interlocked position 56. But, for those locking members 38 that are configured to interlock with notches on the second side 110 of the lifting member 34, the extension of the push/pull rod 82 may cause the locking members 38 to move into the unlocked position 60.

In other examples, the lifting member 34 is constructed to interlock with the locking members 38 through a different arrangement than through a notch. For example, protrusions, ledges, hooks, or other features can be integrated into or attached to the lifting member 34 to provide a mechanism for the locking members 38 to interlock with the lifting member 34.

Figure 7:
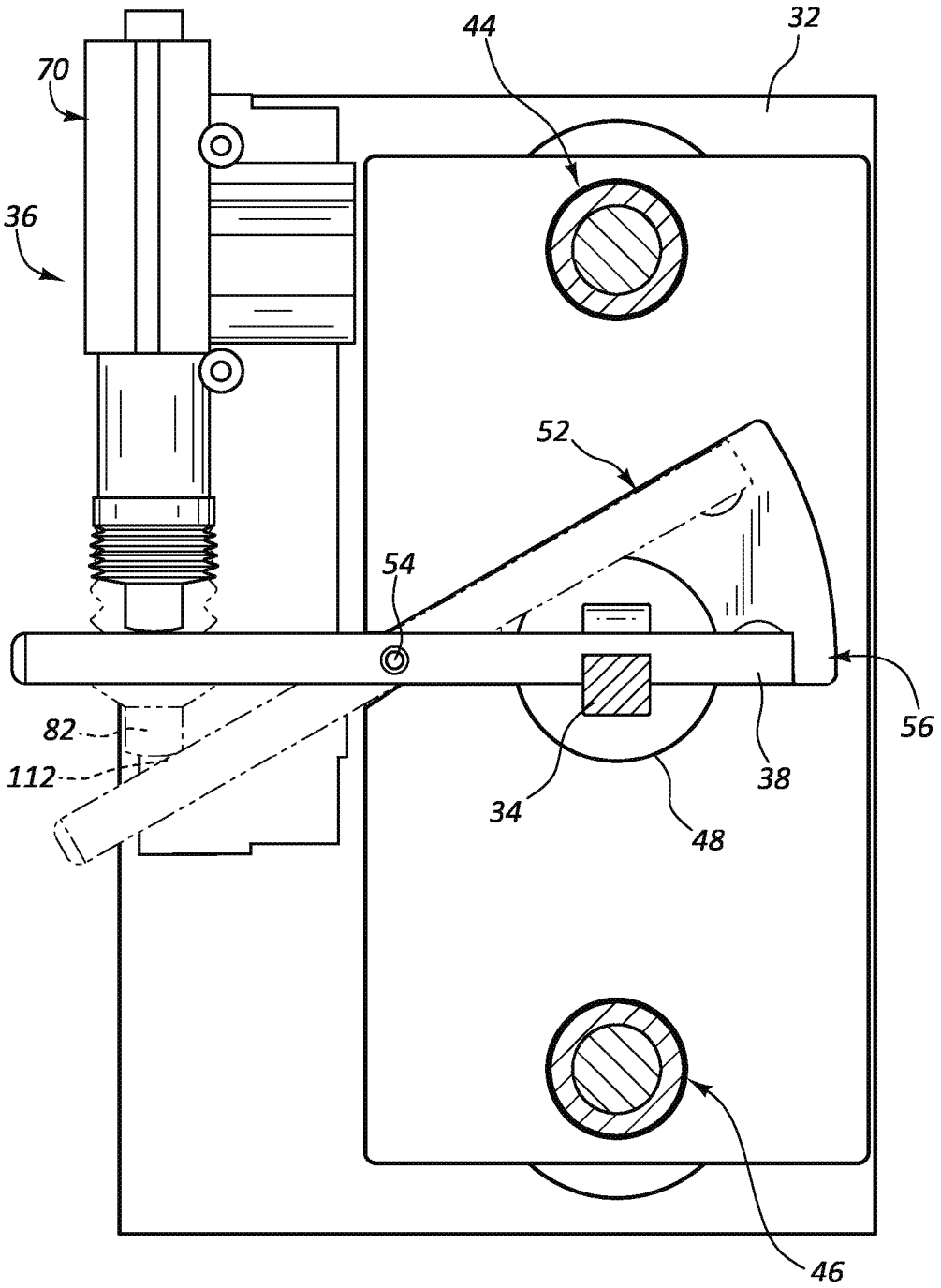
FIG. 7 illustrates a top view of an alternative example of a weight assembly in accordance with the present disclosure.

FIG. 7 illustrates a top view of an example of a weight assembly 16 in accordance with the present disclosure. In this example, the push/pull rod 82 of the linear actuator 70 directly contacts the locking member 38. The head 112 of the push/pull rod 82 may push the locking member 38 into a different position as the push/pull rod 82 extends. Also, the head 112 includes a magnetically conductive material that is capable pulling the locking member 38 back into its original position as the push/pull rod 82 retracts. In the illustrated example, the interlocking magnet 58 and the unlocking magnet 62 may be positioned between the lift opening 48 and the linear actuator 70. However, the interlocking and unlocking magnets 58, 62 may be positioned in any appropriate location of the weight plates 32 as long as the appropriate magnet may be proximate the locking member 38 when the locking member 38 is in the corresponding position.

Figure 8:
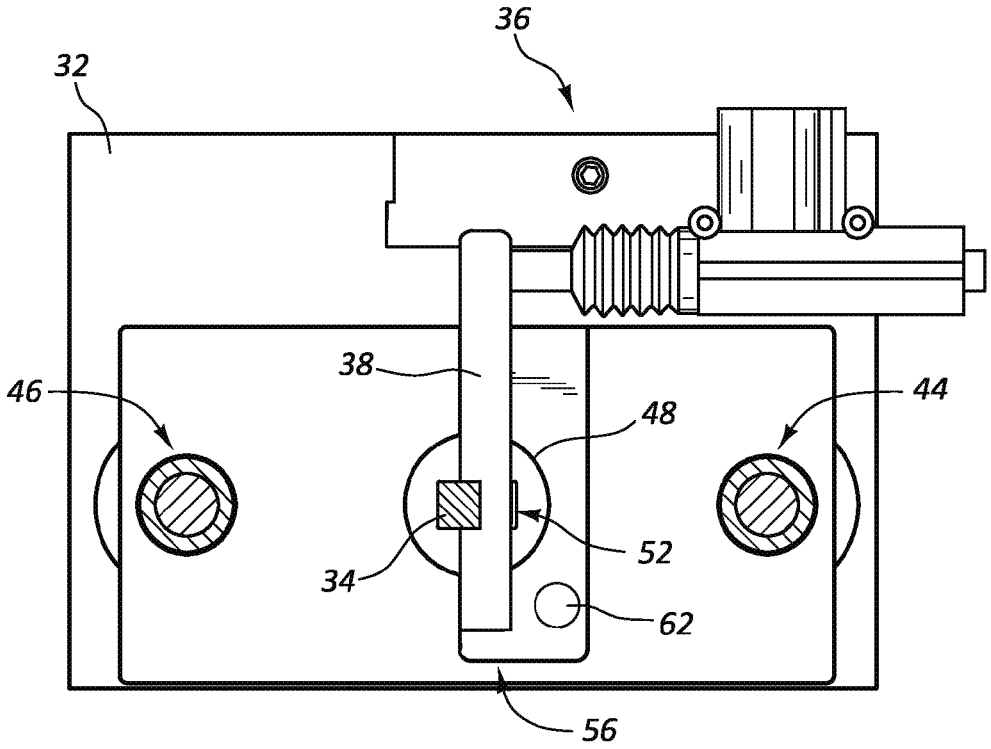
FIG. 8 illustrates a top view of an alternative example of a weight assembly with a locking member interlocked with a lifting member in accordance with the present disclosure.
Figure 9:
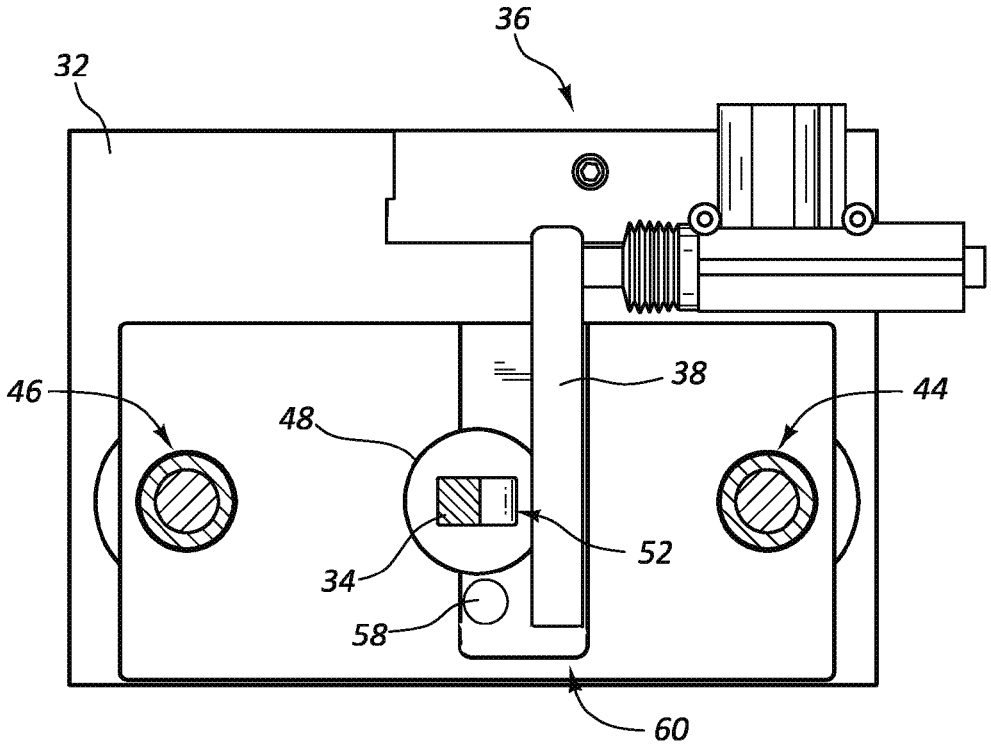
FIG. 9 illustrates a top view of the weight assembly of FIG. 8 with the locking member disengaged from the lifting member.

FIGS. 8 and 9 illustrates a top view of an alternative example of a weight assembly 16 in accordance with the present disclosure. In this example, the locking member 38 is rigidly attached to the linear actuator 70, and the locking member 38 does not pivot about a pivot shaft. Rather, the extension of the push/pull rod 82 translates the locking member 38 into a notch 50 of the lifting member 34. Likewise, a retraction of the push/pull rod 82 translates the locking member 38 out of the notch 50 thereby disengaging the locking member 38 from the lifting member 34.

Figure 10:
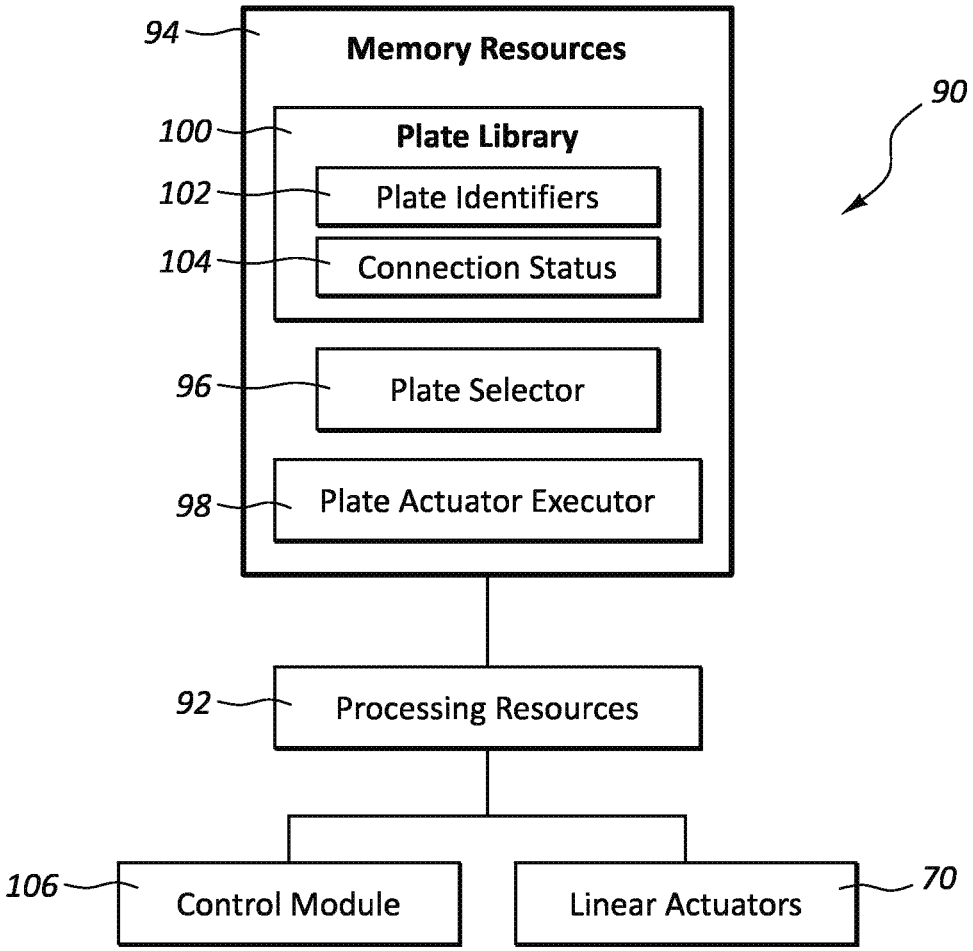
FIG. 10 illustrates block diagram of an example of a selecting system in accordance with the present disclosure.

FIG. 10 illustrates block diagram of an example of a selecting system 90 in accordance with the present disclosure. The selecting system 90 may include a combination of hardware and program instructions for executing the functions of the selecting system 90. In this example, the selecting system 90 includes processing resources 92 that are in communication with memory resources 94. Processing resources 92 include at least one processor and other resources used to process programmed instructions. The memory resources 94 represent generally any memory capable of storing data such as programmed instructions or data structures used by the selecting system 90. The programmed instructions shown stored in the memory resources 94 include a plate selector 96 and a plate actuator executor 98. The data structures shown stored in the memory resources 94 include a plate library 100 that includes a record of plate identifiers 102 and a connection status 104 for each plate.

The memory resources 94 include a computer readable storage medium that contains computer readable program code to cause tasks to be executed by the processing resources 92. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

The plate library 100 may include a record of plate identifiers 102 for each of the plates in the weight assembly 16. Such identifiers may be an alphanumeric symbol, a binary sequence, another type of symbol, or combinations thereof. For each of the identified weight plates, the plate library 100 may maintain an active record the connection status 104 of each of the weight plates 32.

The plate selector 96 represents programmed instructions that, when executed, cause the processing resources 92 to select the weight plates 32 to be interlocked with the lifting member 34. For example, in response to receiving a command from the user through a control module 106 the plate selector 96 consults the plate library 100 to determine which of the weight plates 32 is already interlocked with the lifting member 34. If the command is to interlock forty pounds to the lifting assembly and each weight plate 32 is approximately ten pounds, the plate selector 96 can determine if forty pounds is already interlocked to the lifting member 34 by consulting the plate library 100. In a scenario where the plate library 100 indicates that the first two plates of the weight assembly 16 are already interlocked with the lifting member 34, plate selector 96 may determine that the selectors 36 associated with the third and fourth plate from the top of the weight assembly 16 should be executed to extend the push/pull rods 82. The control module 106 may be integrated directly into the cable exercise machine 10. However, in other examples, the control module 106 is incorporated into a device at a remote location. Such a device may include a phone, a laptop, a desktop, an electronic tablet, a computer, another type of remote location, or combinations thereof.

The plate actuator executor 98 represents programmed instructions that, when executed, cause the processing resources 92 to actuate the linear actuators 70 associated with the selected weight plates. In examples where the actuator is an electro-mechanical actuator, an electrical signal may be sent to the linear actuators 70 to extend the appropriate locking members to interlock with the third and fourth plate.

In another scenario, the plate library 100 may indicate that the first six plates of the weight assembly 16 are currently interlocked with the lifting member 34. In such a scenario, the plate selector 96 may determine that the selectors 36 associated with the fifth and sixth plate from the top of the weight assembly 16 should be executed to retract the push/pull rods 82. Accordingly, the plate actuator executor 98 may send the appropriate signal to the linear actuators 70 to retract the push/pull rods 82 to disengage the locking members 38 from the fifth and sixth weight plates.

The memory resources 94 may be part of an installation package. In response to installing the installation package, the programmed instructions of the memory resources 94 may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources 94 can include integrated memory such as a hard drive, a solid state hard drive, or the like.

In some examples, the processing resources 92 and the memory resources 94 are located within the cable exercise machine 10. The memory resources 94 may be part of the machine's main memory, caches, registers, non-volatile memory, or elsewhere in the machine's memory hierarchy. Alternatively, the memory resources 94 may be in communication with the processing resources 92 over a network. Further, the data structures, such as the libraries, may be accessed from a remote location over a network connection while the programmed instructions are located locally. Thus, the selecting system 90 may be implemented on the cable exercise machine; a user device; a mobile device; a phone; an electronic tablet; a wearable computing device; a head mounted device; a server; a collection of servers; a networked device; a user interface incorporated into a car, truck, plane, boat, bus, another type of automobile; a watch; or combinations thereof. Such an implementation may occur through input mechanisms, such as push buttons, touch screen buttons, voice commands, dials, levers, other types of input mechanisms, or combinations thereof.

The control module 106 may be integrated into the cable exercise machine 10. In such an example, the control module 106 may include a display screen that indicates the current conditions of the cable exercise machine 10. For example, the control module 106 may indicate the current amount of weight that is interlocked with the lifting member 34. In other examples, the control module 106 may indicate an amount of force exerted by the user during the latest pull, a number of calories burned by the user, a physiological parameter such as a heart rate, a breathing rate, an oxygen consumption rate, another of parameter, or combinations thereof. The control module 106 may include an input mechanism that allows the user to send commands for the amount of weight to interlock with the lifting member 34. Such an input mechanism may include a touch screen button, a push button, a microphone, another type of input mechanism, or combinations thereof.

Figure 11:
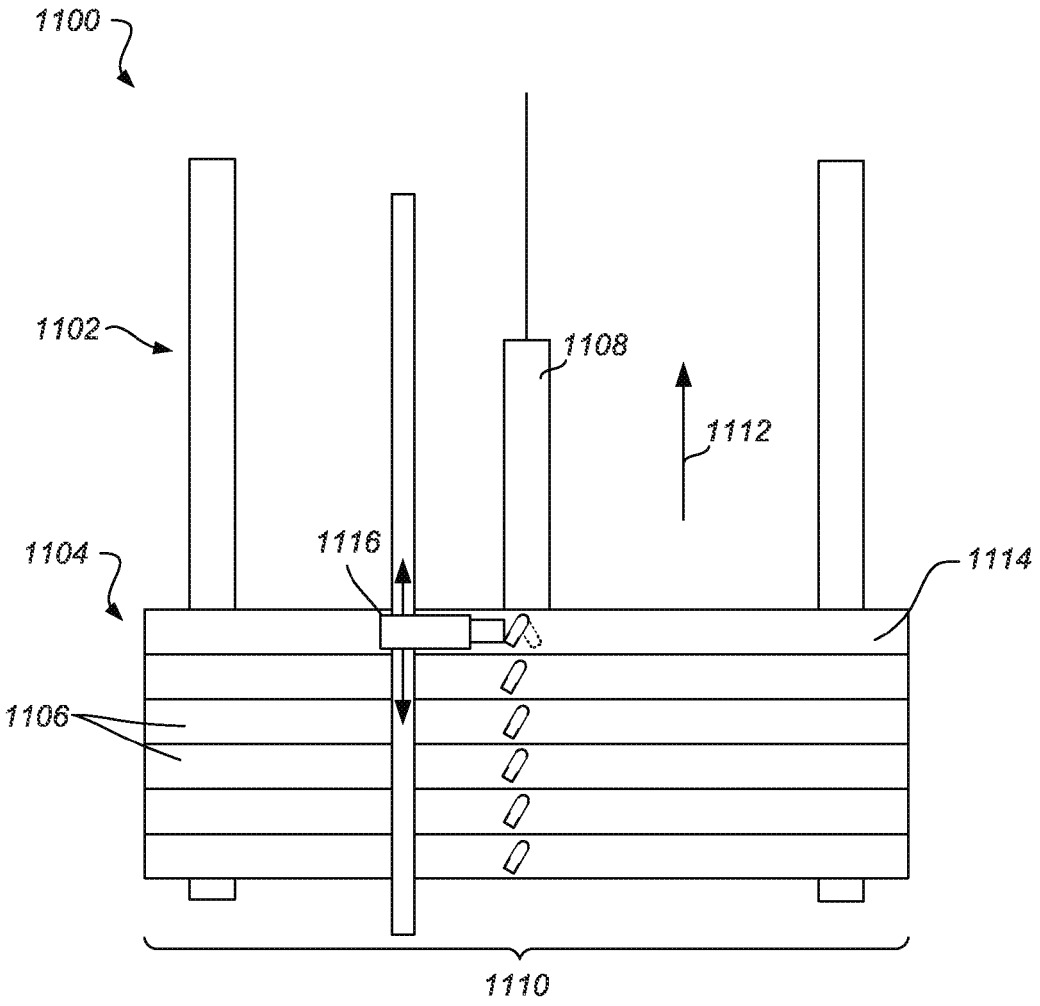
FIG. 11 illustrates a diagram of an example of a selecting system in accordance with the present disclosure.

FIG. 11 depicts an exercise machine 1100 with a frame 1102 and a weight assembly 1104 with multiple plates 1106 that are movably disposed along a vertical length of the frame 1102 with a lifting member 1108. The multiple plates have lift openings may receive the lifting member 1108. The lifting member 1108 is oriented transverse to a plate length 1110 and may travel in a transverse direction 1112 with respect to the plate length 1110. A locking member is associated with at least one plate 1114 of the multiple plates 1106. A selector 1116 that has an ability to cause the locking member to change from an interlocked position where the locking member is interlocked with the lifting member 1108 and an unlocked position where the locking member is disengaged from the lifting member 1108.

Figure 12:
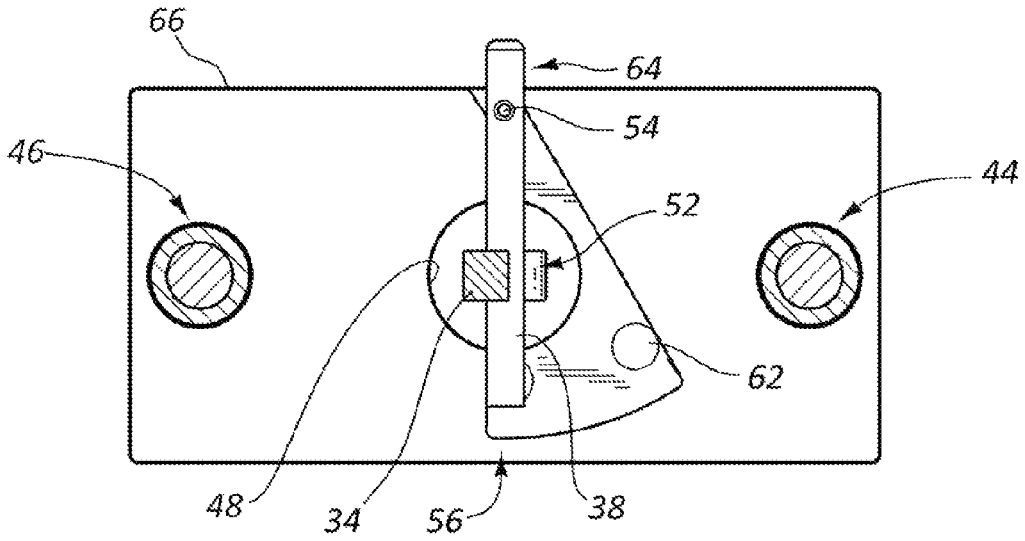
FIG. 12 illustrates a diagram of an example of a selecting system in accordance with the present disclosure.
Figure 13:
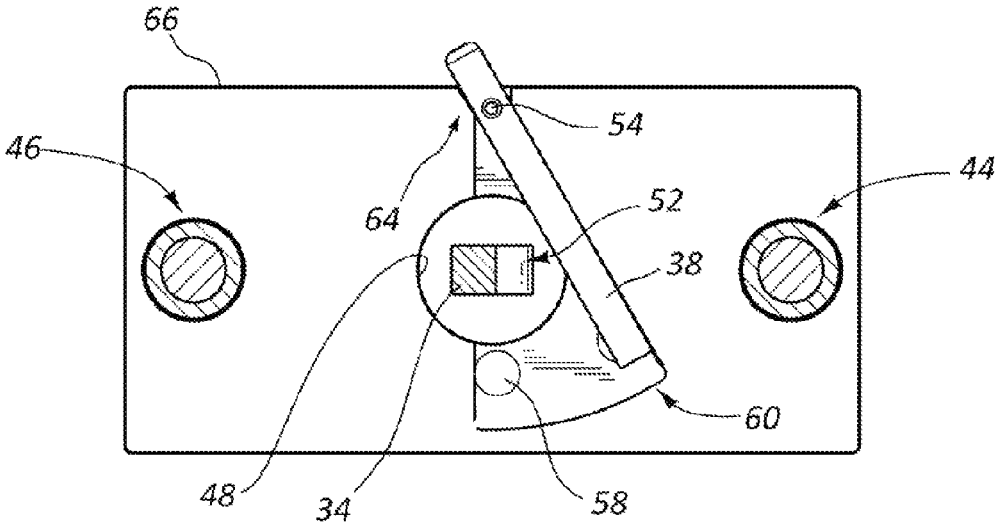
FIG. 13 illustrates a diagram of an example of a selecting system in accordance with the present disclosure.

FIGS. 12 and 13 illustrate an example of a selecting system in accordance with the present disclosure. In this example, no automated selector is involved with moving the locking member 38. In such an example, the exposed end 64 of the locking member 38 may be moved manually by the user. In such a situation, the user may move the exposed end 38 of the locking member 38 to a interlocked position as illustrated in FIG. 12 where the locking member 38 is interlocked with the lifting member 34. The user may also move the exposed end 64 of the locking member 38 to a unlocked position as illustrated in FIG. 13 where the locking member is not interlocked with the lifting member 34.

While the above examples have been described with reference to specific types of locking members, any appropriate type of locking member may be used in accordance with the principles described in the present disclosure. For example, the locking member may be a pin, a rod, a bar, a cylinder, a loop, a screw, a fork, a bi-stable mechanism, another type of locking member, or combinations thereof. Also, while the above examples have been described with specific reference to weight plates that incorporate magnets to aid in retaining the locking members in their appropriate positions, in some examples, no magnets are incorporated into weight plates.

Further, while the examples above has been described with specific reference to the selectors remaining stationary with the respect to the cable exercise machine's frame as the weight plates move with the lifting member, in some examples, at least one of the selectors may move with at least one of the weight plates as the weight plate is lifted by the lifting member. Additionally, while the above examples have been described as being incorporated into a specific type of cable exercise machine, the principles herein may be incorporated into any appropriate type of cable exercise machine, including, but not limited to, cable exercise machines that allow a user to do exercises that work latissimus dorsi muscles, pectoral muscles, bicep muscles, tricep muscles, deltoid muscles, trapezius muscles, other muscles, and combinations thereof.

INDUSTRIAL APPLICABILITY

In general, the invention disclosed herein may provide a user with a cable exercise machine where the user does not have to manually retrieve, manually rotate, or manually insert a removable pin to change the amount of weight loaded to the lifting member. Such an automated approach allows the cable exercise machine to have a covering around the stack of weight plates for aesthetics or other functional purposes. Further, the user does not have to use a removable pin, which is a small component of the exercise machine that is prone to getting lost.

The linear actuators that are described in some of the above mentioned examples, provide a simple low power mechanism for interlocking and unlocking the locking member with the lifting member. Also, the actuator lever provides a simple mechanism to follow the movement of the push/pull rod of the linear actuator. The combined simplicity of the linear actuator and the actuator lever provide a robust switching mechanism that can have a long useful operating life. Additionally, the shape of the contact end of the actuator lever of some of the examples described above provides a mechanism that is reliable for switching the position of the locking member while at the same time preventing the actuator lever from getting caught on the exposed ends of the locking members as the weight plates move with the lifting member.

In those examples where each locking member of each weight plate to be lifted is interlocked with the lifting member, the load on the lifting member is distributed throughout the lifting member. As a result, the lifting member can experience an increased operating life or be constructed of a material that takes advantage of the load distribution.

The notch incorporated into the side of the lifting member allows for a locking member that is pivotally attached to the weight plate to interlock with the lifting member from the side. Such an approach reduces the amount of travel that the push/pull rod has to take to satisfactorily interlock the locking member with the lifting member allowing the linear actuator to have a smaller stroke and thereby lower the energy consumption of the linear actuator.

The exercise machine may include a frame and a weight assembly. The weight assembly may include multiple plates that are moveably disposed along a vertical length of the frame. A lifting member may be used to lift and lower the plates along the frame's length. The plates may include lift openings that receive and guide the lifting member. The lifting member may be oriented transverse to a plate length and may travel in a transverse direction with respect to the plate length. For example, the lift openings may be formed in the center of the stack of weights. Each of the lifting openings may be aligned with the other to define a collective opening that spans the length of the weight assembly. The lifting member may move freely within the collective opening when unhook from locking members associated with the weight plates.

A locking member may be associated with at least one plate of the multiple plates. In some examples, each weight plate has its own locking member. A selector may be associated with one or more locking members and may have the ability to cause the locking member to change from an interlocked position to an unlocked position. When in the unlocked position, the locking member is interlocked with the lifting member. When in the unlocked position, the locking member is disengaged from the lifting member. The locking member may be incorporated within the plates. For example, the locking member may be disposed within a cavity formed in the plates and may be secured to the plates with a pivot rod. A free end of the locking member may be in contact with the selector on the outside of the weight plates. As the free end is push, the rest of the locking member may move by pivoting about the pivot rod. A locking end, opposite the free end along the longest dimension of the locking member, may move into and out of the collective opening where the lifting member travels. As the locking end of the locking member moves into the lift openings, the locking end may interlock with the lifting the member if a portion of the lifting member is at the appropriate vertical height. By interlocking with the lifting member, the locking member secures the weight plate to the lifting member. Thus, as the lifting member moves vertically, the weight plate may move with the lifting member. Further, in those situations where the other weight plates are superjacent to the interlocked weight plate and rest on the weight plate, all of the superjacent weight plates may travel with the lifting member.

The locking member may be held in place when the selector is not being actuated to move the locking member. For example, to prevent the locking member from slipping out of place, a interlocking magnet may be incorporated into the weight plate and positioned proximate the location where the locking member may be when the locking member is in the interlocking position. The magnetic field of the magnet may impose a force that maintains the locking member in the interlocked position. Likewise, a unlocking magnet may be positioned in the cavity of the weight plate so as to be proximate the locking member when the locking member is in the unlocked positioned. In such an example, the unlocking magnet may be used to prevent the locking member from unintentionally interlocking with the lifting member.

Further, the locking member may include a permanent magnet for increasing the magnetic attraction between the locking member and the interlocking and unlocking magnets. For example, the magnet of the locking member may be oriented in one polar direction and the interlocking and unlocking magnets oriented in an opposite polar direction so that the opposite poles attract each other.

The locking member may be partially disposed within a cavity formed in the weight plate. The cavity may be fully enclosed with the exception of an entrance where the exposed end protrudes out of the weight plate. In other examples, the cavity is open on the underside of the weight plate. The cavity may include walls that limit the locking member's range of pivot motion. The walls of the cavity may provide a location to secure the interlocking magnet and the unlocking magnet. However, the magnets may be located above or below the locking member as well when the locking member is in either of the positions. In yet other examples, the locking member is attached below the weight plate or another location outside of a cavity of the weight plate. As used herein, the term "positioned proximate" broadly encompasses all of these examples of positions of the magnets relative to the walls of the cavity.

The cavity may be lined with a non-magnetic material such as a polymer or stainless steel. Such a lining may provide a low friction surface or protection from the environment. In other embodiments, the interlocking magnet and the unlocking magnet may abut a non-magnetic material. Alternately, the interlocking magnet and the unlocking magnet may be encased in a non-magnetic material.

In some examples, the exercise machine includes a frame and weight assembly with multiple plates moveably disposed along a vertical length of the frame. The exercise machine further includes a lifting member selectively engaged with the weight assembly. The multiple plates each include at least one lift opening that receives the lifting member. The lifting member may be oriented transverse to a plate length and may travel in a transverse direction with respect to the plate length. The exercise machine further includes a locking member associated with at least one plate of the multiple plates, a interlocking magnet may retain the locking member in a interlocked position; and a unlocking magnet may retain the locking member in a unlocked position. When the locking member is in the interlocked position, the locking member is interlocked with the lifting member. When the locking member is in the unlocked position, the locking member is disengaged from the lifting member.

In such examples, the locking member may be connected to the at least one plate with a pivot shaft. The interlocking magnet may be positioned on an opposite side of the lift opening from the pivot shaft. The locking member may have an interlocking region that resides in a notch formed in the lifting member. The frame may include guide posts that are partially disposed within guide openings that are positioned on opposing sides of the multiple plates, the guide posts being oriented to guide the multiple plates as the multiple plates move along the vertical length of the frame. The interlocking magnet and unlocking magnet may be incorporated into the at least one plate of the multiple weight plates. The locking member may be partially disposed within a cavity formed in the weight plate. The cavity may include an entrance through which the exposed end of the locking member protrudes, an opening formed in the underside of the weight plate, a first wall located to position the locking member in the interlocked position, and a second wall located to position the locking member in the unlocked position. The interlocking magnet may be positioned adjacent the first wall and the cavity and the unlocking magnet is positioned adjacent the second wall and the cavity.

Any appropriate type of actuator may be used in the selector to cause the selector to move the free end of the locking member. For example, a linear actuator may be incorporated into the selector to make contact and move the free end of the locking member. In some examples, the free end of the locking member and at least part of the moving member of the actuator are connected. In such an example, when the actuator retracts, the free end of the locking member is repositioned in accordance with the position of the actuator. The actuator may be in communication with a controller that is located locally on the weight machine or is located elsewhere. The controller may send commands to cause at least one of the selectors to actuate and thereby interlocked the locking member with the lifting member. Such commands may be sent wirelessly, through a network, or through a hard wire connection.

In some cases, a single selector is capable of moving with respect to the weight plates. In such an example, the selector may service multiple plates. Such a selector may move within a range of weight plates or all of the weight plates to cause the locking member to interlock the desire weight plate with the lifting member. In such an example, there are fewer selectors than weight plates.

In another example, each of the weight plates has its own selector. In such an example, the selector associated with the weight plate of the desired overall weight can be actuated to load the desire weight to the lifting member. In some scenarios, just a single weight plate is interlocked with the lifting member. In such a scenario, all of the weight is loaded to the locking member. In other scenarios, multiple selectors may be actuated to interlock more than one weight plate to the lifting member. As a result, the load can be distributed to multiple locking members. By distributing the load, the locking members may have an increased life.

What is claimed is:

1. A weight plate for use in a weight stack of an exercise machine comprising:

a locking member moveably attached to the weight plate, wherein the locking member is configured to pivot between an interlocked position and an unlocked position;

an interlocking magnet incorporated into the weight plate and positioned proximate a location where the locking member is when the locking member is in the interlocking position to retain the locking member in the interlocked position, and an unlocking magnet incorporated into the weight plate and positioned proximate a location where the locking member is when the locking member is in the unlocked position to retain the locking member in the unlocked position.

2. The weight plate of claim 1, further comprising a cavity defined by the weight plate, wherein the locking member is at least partially disposed within the cavity.

3. The weight plate of claim 2, wherein the cavity is defined by an entrance through which an exposed end of the locking member extends, a first wall located adjacent the locking member in the interlocked position, and a second wall located adjacent the locking member in the unlocked position.

4. The weight plate of claim 3, wherein the interlocking magnet is positioned proximate the first wall, wherein the unlocking magnet is positioned proximate the second wall.

5. The weight plate of claim 1, wherein the locking member is connected to the weight plate via a pivot shaft.

6. The weight plate of claim 5, further comprising a lift opening formed in the weight plate, wherein the interlocking magnet is positioned on the weight plate on a first side of the lift opening, wherein the pivot shaft is positioned on the weight plate on a second side of the lift opening.

7. The weight plate of claim 6, further comprising a plurality of guide openings formed in the weight plate.

8. An exercise machine, comprising:

a weight assembly including multiple plates;

a lifting member selectively engaged with the weight assembly, the lifting member is connected to an end of a pull cable;

a locking member associated with at least one plate of the multiple plates, wherein the locking member is configured to pivot between an interlocked position and an unlocked position;

an interlocking magnet incorporated into the at least one plate and positioned proximate a location where the locking member is when the locking member is in the interlocking position to retain the locking member in the interlocked position, and an unlocking magnet incorporated into the at least one plate and positioned proximate a location where the locking member is when the locking member is in the unlocked position to retain the locking member in the unlocked position, wherein when the locking member is in the interlocked position, the locking member is interlocked with the lifting member, and wherein when the locking member is in the unlocked position, the locking member is disengaged from the lifting member.

9. The exercise machine of claim 8, wherein the locking member is connected to the at least one plate via a pivot shaft.

10. The exercise machine of claim 9, further comprising a lift opening defined by the multiple plates;

wherein the interlocking magnet is positioned on the at least one plate on a first side of the lift opening; and wherein the pivot shaft is positioned on the at least one plate on a second side of the lift opening.

11. The exercise machine of claim 8, further comprising: at least one notch defined by the lifting member;

wherein the locking member includes an interlocking region that engages the notch when the locking member is in the interlocked position.

12. The exercise machine of claim 8, further comprising a frame;

wherein the frame includes a plurality of guide posts oriented to guide the multiple plates as the multiple plates move along a vertical length of the frame; and a plurality of guide openings defined on opposing sides of the multiple plates;

wherein the plurality of guide posts are partially disposed within the guide openings.

13. The exercise machine of claim 8, wherein the interlocking magnet and the unlocking magnet are formed in the at least one plate of the multiple plates.

14. The exercise machine of claim 8, further comprising: a cavity defined by the at least one plate;

wherein the locking member is at least partially disposed within the cavity.

15. The exercise machine of claim 14, wherein the locking member further comprises a protrusion;

wherein the protrusion includes an exposed end that extends beyond the cavity.

16. The exercise machine of claim 14, wherein the cavity comprises an opening defined in an underside of the at least one plate.

17. The exercise machine of claim 14, wherein the cavity is defined by a first wall located to position the locking member in the interlocked position.

18. The exercise machine of claim 17, wherein the interlocking magnet is positioned adjacent the first wall.

19. The exercise machine of claim 17, wherein the cavity is defined by a second wall located to position the locking member in the unlocked position.

20. The exercise machine of claim 19, wherein the unlocking magnet is positioned adjacent the second wall.

* * * * *